US005193810A

United States Patent [19]

Antonious

[11] Patent Number: 5,193,810

[45] Date of Patent: Mar. 16, 1993

[54] WOOD TYPE AERODYNAMIC GOLF CLUB HEAD HAVING AN AIR FOIL MEMBER ON THE UPPER SURFACE

[76] Inventor: Anthony J. Antonious, 7738 Calle Facil, Sarasota, Fla. 34238

[21] Appl. No.: 788,926

[22] Filed: Nov. 7, 1991

[51] Int. Cl.[5] ..... A63B 53/04

[52] U.S. Cl. ..... 273/167 E; 273/164.1

[58] Field of Search ..... 273/183 D, 193 R, 194 R, 273/194 A, 167-175, 79, 164, 163 R, 77 R, 77 A; D21/214-220

[56] References Cited

U.S. PATENT DOCUMENTS

| | | | |
|---|---|---|---|
| D. 93,862 | 11/1934 | Barnhart | D21/214 |
| D. 185,717 | 7/1959 | Newton | 273/167 E |
| D. 192,515 | 4/1962 | Henrich | 273/167 E |
| D. 231,625 | 5/1974 | Werner | D21/219 |
| D. 231,850 | 6/1974 | Winter | D21/219 |
| D. 257,873 | 1/1981 | MacDougall | 273/167 E |
| 1,319,802 | 10/1919 | Shea | 273/164 |
| 1,690,388 | 11/1928 | Waldron | 273/164 X |
| 3,992,013 | 11/1976 | Golden | 273/171 X |
| 3,997,170 | 12/1976 | Goldberg | 273/167 E X |
| 4,065,133 | 12/1977 | Gordos | 273/167 E |
| 4,749,196 | 6/1988 | Podgor | 273/164 |
| 4,930,783 | 6/1990 | Antonious | 273/164 |
| 5,092,599 | 3/1992 | Okumoto et al. | 273/167 E |

FOREIGN PATENT DOCUMENTS

| | | | |
|---|---|---|---|
| 324620 | 1/1930 | United Kingdom | 273/164 |

*Primary Examiner*—V. Millen
*Assistant Examiner*—Sebastiano Passaniti
*Attorney, Agent, or Firm*—Aquilino & Welsh

[57] ABSTRACT

A wood type golf club head having a raised, aerodynamic air foil member extending upwardly from the top surface and positioned with its longitudinal axis extending rearwardly from the ball striking face toward the rear edge of the club head. The improved air foil member redirects and creates a favorable air flow pattern as the golf club head is swung, which spills over to the rear of the club head and decreases drag, thereby enabling a golfer to hit a golf ball further and straighter for a given force during the execution of a golf swing.

9 Claims, 9 Drawing Sheets

FIG. 1
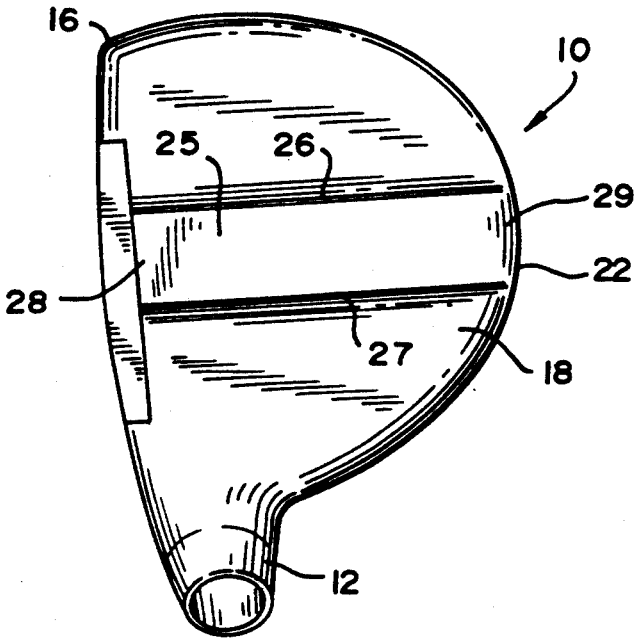
FIG. 2
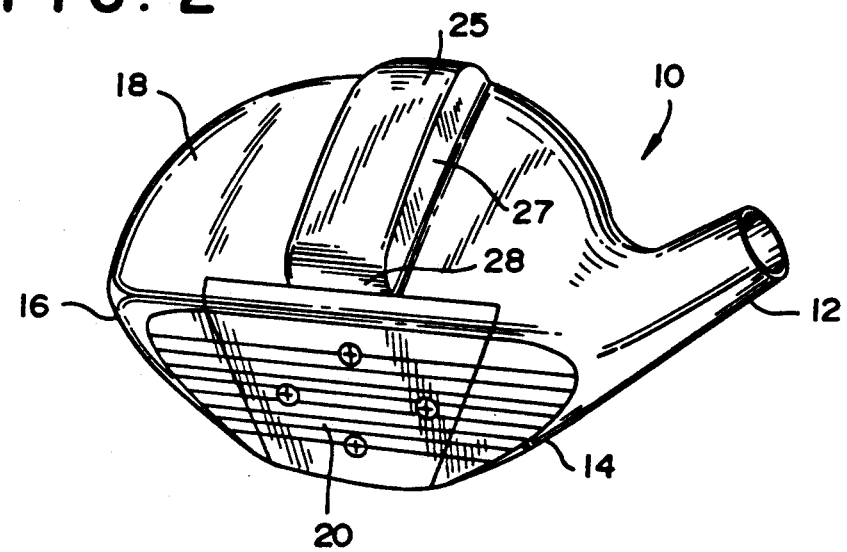
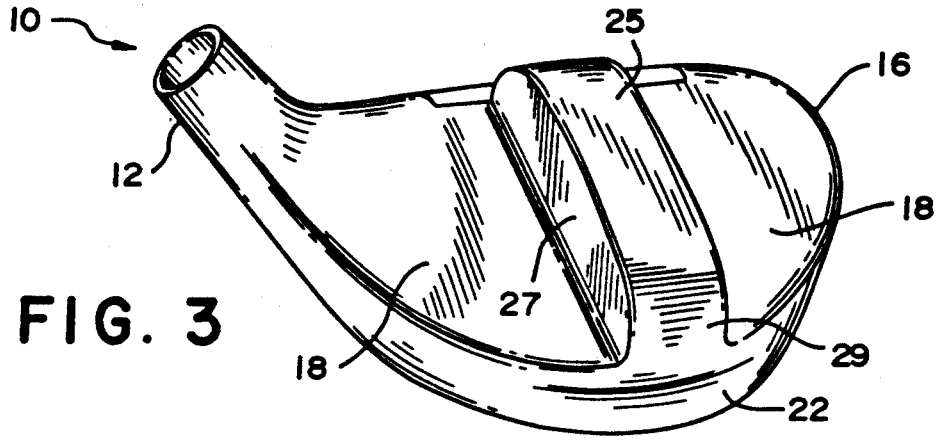
FIG. 3

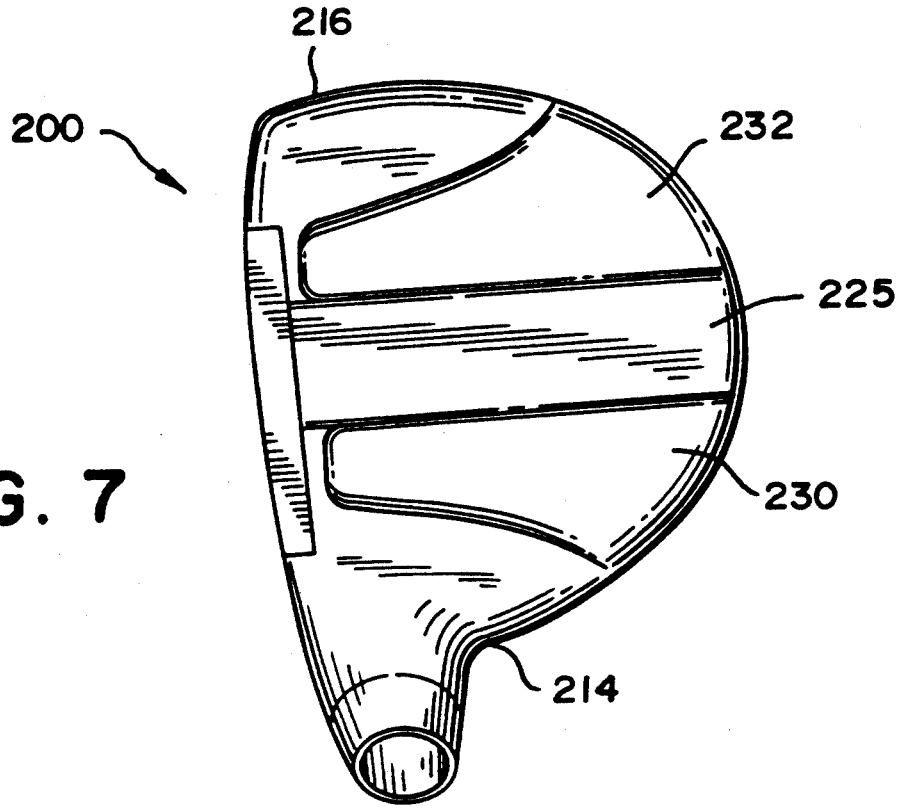
FIG. 7
FIG. 8
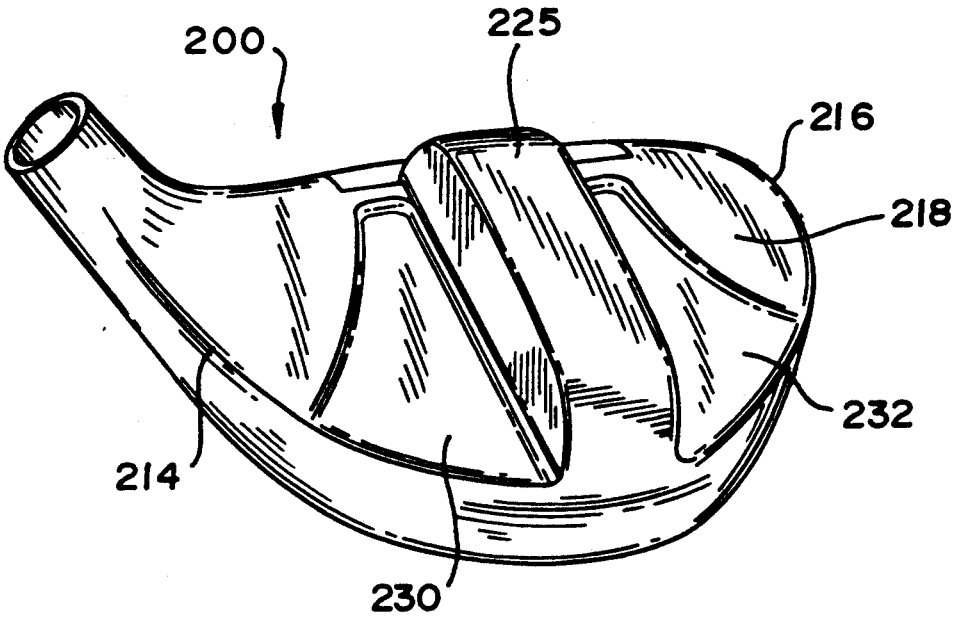

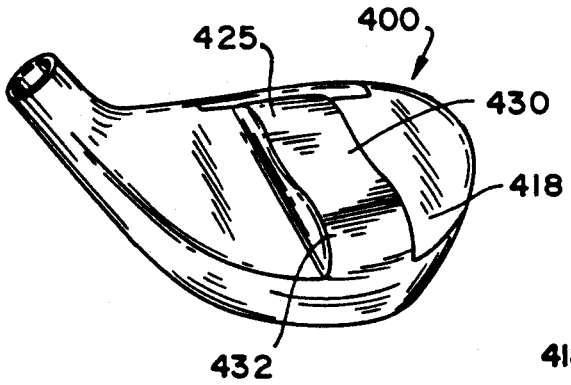
FIG. 12
FIG. 11
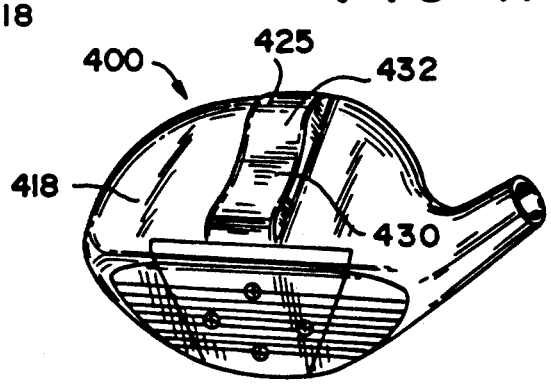
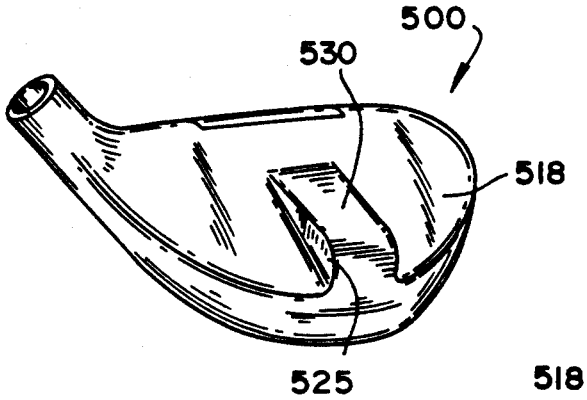
FIG. 14
FIG. 13
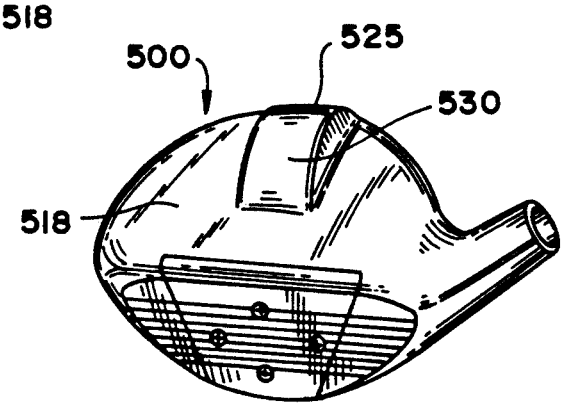
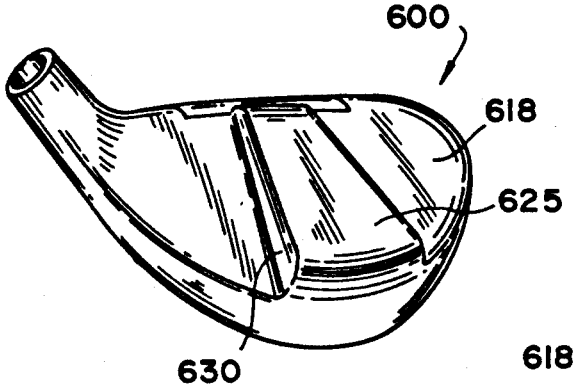
FIG. 16
FIG. 15
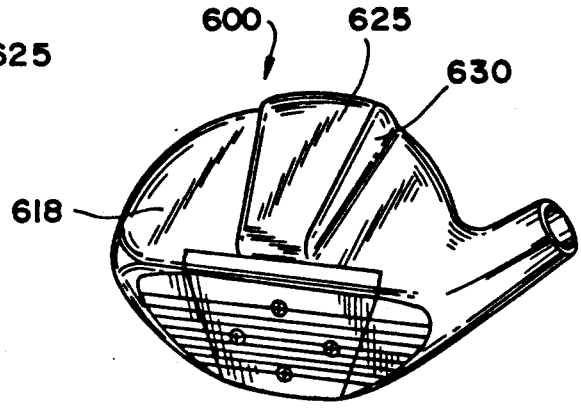

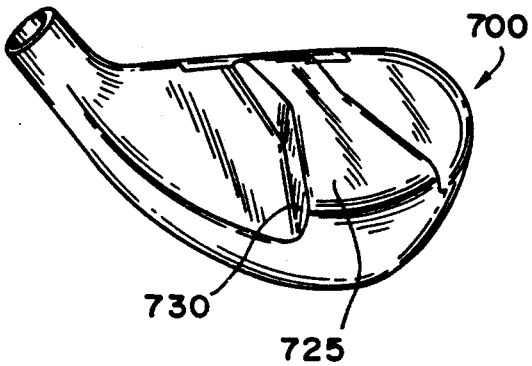
FIG. 18
FIG. 17
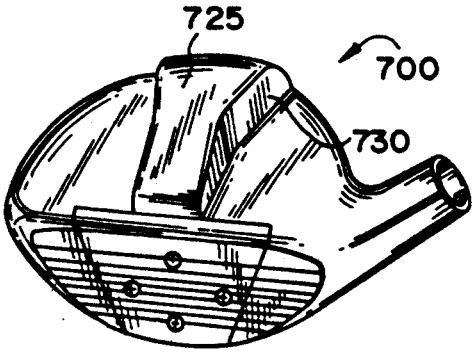
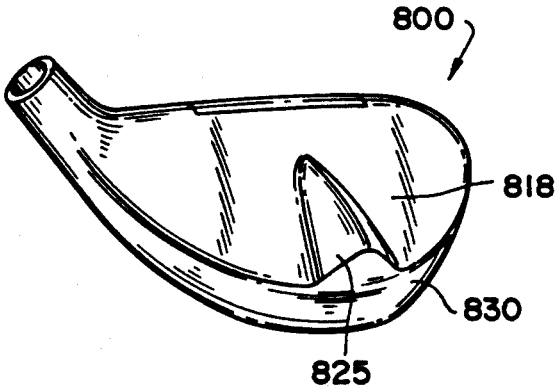
FIG. 20
FIG. 19
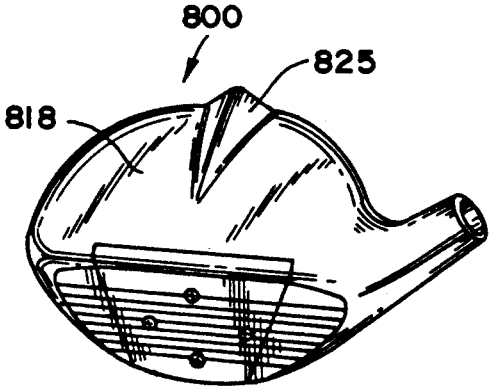
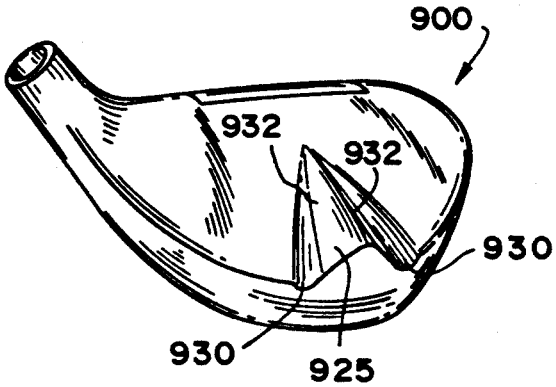
FIG. 22
FIG. 21
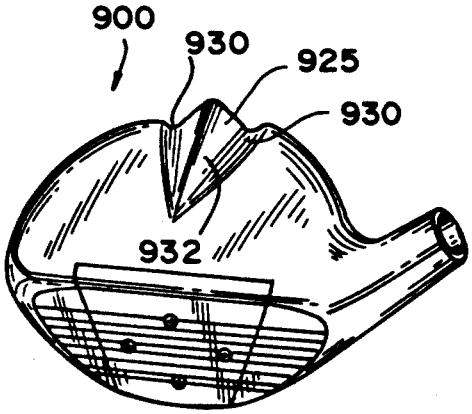

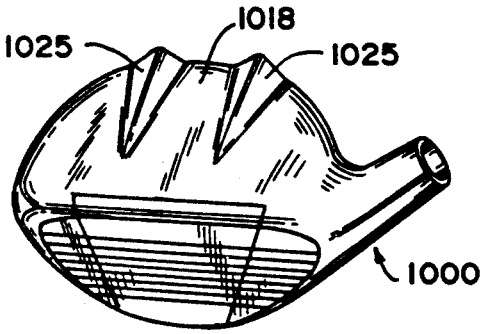
FIG. 23
FIG. 24
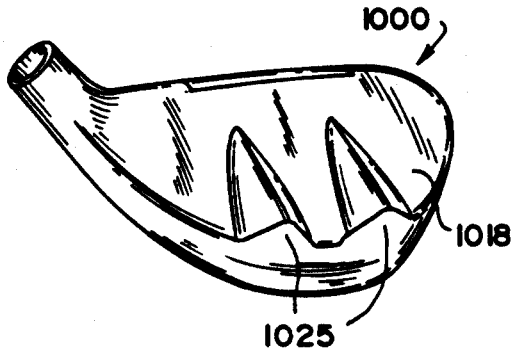
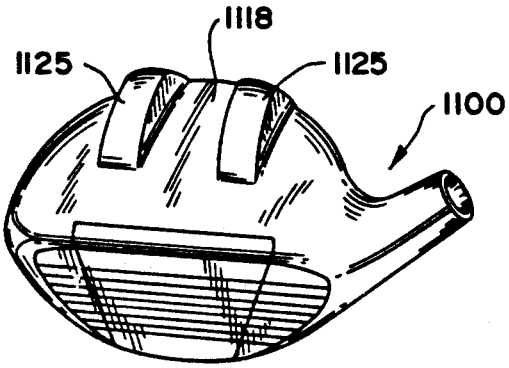
FIG. 25
FIG. 26
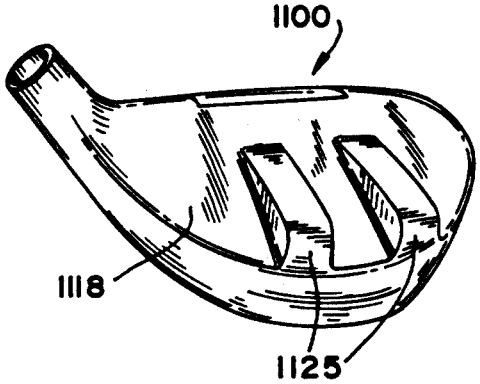
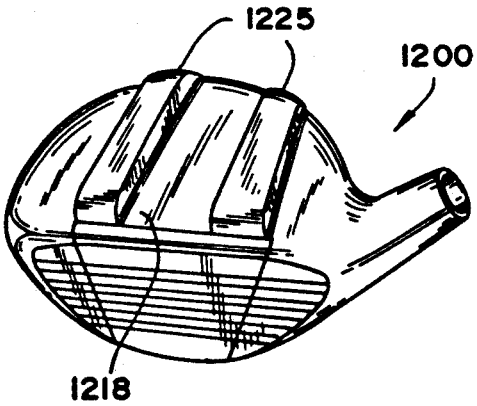
FIG. 27
FIG. 28
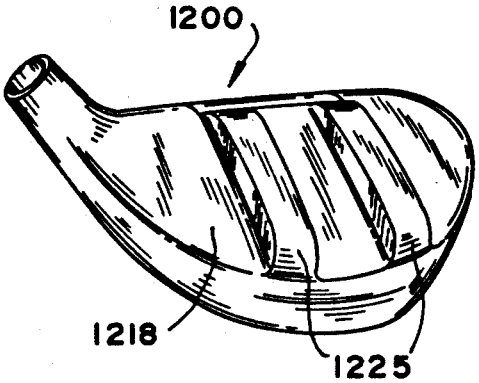

WOOD TYPE AERODYNAMIC GOLF CLUB HEAD HAVING AN AIR FOIL MEMBER ON THE UPPER SURFACE

BACKGROUND AND DESCRIPTION OF THE INVENTION

The present invention relates to golf club heads, and more particularly, to wood type golf club heads having an aerodynamic upper surface to reduce drag and increase club head speed and stability as it is swung during the execution of a golf swing.

Wood type golf clubs are used for hitting a golf ball a longer distance, such as drivers, which are used for the first shot of a given hole from a teed position to obtain maximum distance, and are also used from the fairway for subsequent shots that also require the ball to travel a long distance toward or onto the putting green. The distance a golf ball travels is determined by the club head speed at the moment of impact and the weight of the club head, in accordance with well known physical laws. Conventional golf clubs are provided with a generally flat, broad face and an asymmetric overall shape. Such designs have been known extensively for a number of years. This typical wood type golf club head, although it has some aerodynamic characteristics, has been found to create substantial air turbulence causing considerable aerodynamic drag, which reduces the speed of the club head for a given force executed by a golfer.

Various efforts have been made to increase club head speed by reducing aerodynamic drag, as shown in my prior U.S. Pat. Nos. 3,468,544 and 4,828,265, among others. Another patent of interest is U.S. Pat. No. 2,550,846 to Milligan, which shows a golf club head having a shallow recess in the top surface and bottom of the club head. Another patent to Gordos (U.S. Pat. No. 4,065,133) shows a golf club head having a plurality of spaced grooves which are deep, but which are relatively small and narrow compared to the overall size of the club head. The patent to Goldberg (U.S. Pat. No. 3,997,170) shows a club head having a plurality of parallel grooves which are also relatively shallow with respect to the overall club head size. A patent to Bock (U.S. Pat. No. Des. 240,748) shows a golf club head with an air foil rear surface. The patent to Sinclair (U.S. Pat. No. 4,900,029) relates to a golf club head having a vertical air foil and a cavity formed in the upper surface to achieve less drag as the club head is swung.

Still another golf club head is shown in the design patent to Henrich (U.S. Pat. No. Des. 192,515) having an aerodynamic upper surface with a pair of air foil members extending rearwardly from the ball striking face. A design patent to Newton (U.S. Pat. No. Des. 185,717) shows a wood type golf club head with a thin member on the upper surface thereof. Finally, the patent to Phillips (U.S. Pat. No. Des. 183,180) shows a golf club head, which appears to be a putter, having a triangularly-shaped upper surface.

SUMMARY OF THE INVENTION

The present invention is directed to a golf club structure which achieves increased club head speed when it is swung, without the need for changing the overall length, width or other major characteristics of the club. This is accomplished by reducing the undesirable air turbulence which increases aerodynamic drag on the club head as it is swung by creating a more desirable Laminar-type controlled air flow path as it passes across the club head top surface, thus enabling a player using the club to hit a ball further for a given application of force during a swing. The arrangement also provides aerodynamic stability which permits increased control of the club head position, especially at impact, thereby producing a more consistent swing and greater accuracy while making the club head swing and feel lighter.

The club head of the present invention is provided with a raised aerodynamic shape on the top or upper surface, which is generally rectangular in shape and is positioned just behind the ball striking face to a point adjacent the rear edge of the club head. Air flowing over this air foil member across the top of the club head alters the conventional air flow dynamics and breaks up an area of low pressure behind the club head produced by conventional designs. This increase in pressure at the rear of the club head counteracts the higher aerodynamic pressure on the club face and thus decreases the aerodynamic drag of the club head. The shape and size of the air foil member is aesthetically consistent with the overall shape of the club head, while achieving the reduced drag effect. A preferred configuration of the air flow member takes a generally rectangular shape having its longitudinal axis in front-to-rear direction on the top surface of the club head. Preferably, the air foil member is at least ¼ inch above the main top surface of the club head, and approximately 2½ inches long and ½ to 1 inch wide. Other embodiments include a pair of air flow channels longitudinally positioned and cut into the main top surface along the longitudinal edge of the air foil member to quickly induce a desired Laminar air flow across the top of the club head.

A primary object of the present invention is to provide a golf club head having an improved aerodynamic top surface to substantially reduce drag and improve swing stability. A further object is to provide a golf club head which increases the club head speed and lift, thereby reducing the apparent swing weight of the club head for a given application of force during the execution of a golf swing.

Other objects and advantages of the present invention will become apparent from the following description of the preferred embodiments taken in conjunction with the accompanying drawings. The objectives and advantages of the invention will be realized and obtained by means of the elements, limitations and combinations particularly pointed out in the appended claims. The accompanying drawings, which are incorporated in and constitute a part of the specification, illustrate several embodiments in the invention, and together with the description, serve to explain the principles thereof.

DESCRIPTION OF THE DRAWINGS

FIG. 1 is a top plan view of a golf club head of the present invention.

FIG. 2 is a front perspective view of the club head of FIG. 1.

FIG. 3 is a rear perspective view thereof.

FIG. 7 is a top plan view of a third embodiment of the present invention.

FIG. 8 is a rear perspective view of the club head of FIG. 7.

FIG. 11 is a front perspective view of a fifth embodiment of the present invention.

FIG. 12 is a rear perspective view of the club head of FIG. 11.

FIG. 13 is a front perspective view of a sixth embodiment of the present invention.

FIG. 14 is a rear perspective view of the club head of FIG. 13.

FIG. 15 is a front perspective view of a seventh embodiment of the present invention.

FIG. 16 is a rear perspective view of the club head of FIG. 15.

FIG. 17 is a front perspective view of an eighth embodiment of the present invention FIG. 18 is a rear perspective view of the club head of FIG. 17.

FIG. 19 is a front perspective view of a ninth embodiment of the present invention.

FIG. 20 is a rear perspective view of the club head of FIG. 19.

FIG. 21 is a front perspective view of a tenth embodiment of the present invention.

FIG. 22 is a rear perspective view of the club head of FIG. 20.

FIG. 23 is a front perspective view of an eleventh embodiment of the present invention.

FIG. 24 is a rear perspective view of the club head of FIG. 23.

FIG. 25 is a front perspective view of a twelfth embodiment of the present invention.

FIG. 26 is a rear perspective view of the club head of FIG. 25.

FIG. 27 is a front perspective view of a thirteenth embodiment of the present invention.

FIG. 28 is a rear perspective view of the club head of FIG. 27.

DESCRIPTION OF PREFERRED EMBODIMENTS

Figure 4:
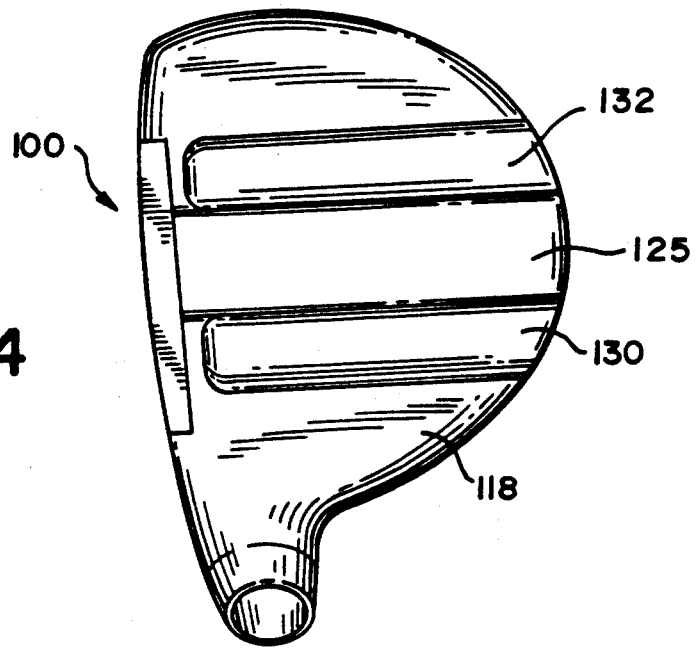
FIG. 4 is a top plan view of a second embodiment of the invention.

FIGS. 1 through 3 illustrate a wood type golf club head 10 in accordance with the present invention, including a hosel 12, a heel 14, a toe 16, an upper top surface 18 and ball striking face 20.

The improvement resides in the aerodynamic shape of the upper surface 18, including a raised, geometrically shaped air foil member 25, longitudinally positioned on the top surface between the ball striking face 20 and a rear surface 22 of the club head. In a preferred embodiment, the air foil member 25 is rectangular in shape and is at least ¼ inch high above the upper top surface 18, approximately 2½ inches long and ½ to 1 inch wide. When the golf club is swung, air cascades over the ball striking face 20 across the top surface 18 of the club head 10. With a conventional club head, this air flow pattern creates an area of low pressure behind the club head 10, which causes drag and reduces club head speed as the club is being swung, for a given effort by a player. With the present invention, the air foil member 25 disrupts the aerodynamic pattern of the air flow, causing turbulence, which in turn is smoothly redirected over the rear of the club head and greatly affects the drag caused by the low pressure. For this reason, a golf club head with the air foil member 25 of the present invention can be swung faster for a given effort to increase the energy transfer to a golf ball being hit, thereby enabling it to fly further than with a conventional club head.

The air foil member 25 has sides 26 and 27 which are parallel to each other in a direction generally perpendicular to the ball striking face 20 and the rear surface 22. The air foil member 25 includes a leading edge 28 adjacent to but slightly behind the ball striking face 20 and a trailing edge 29 which is coincident with the rear surface 22 of the club head 10.

Figure 5:
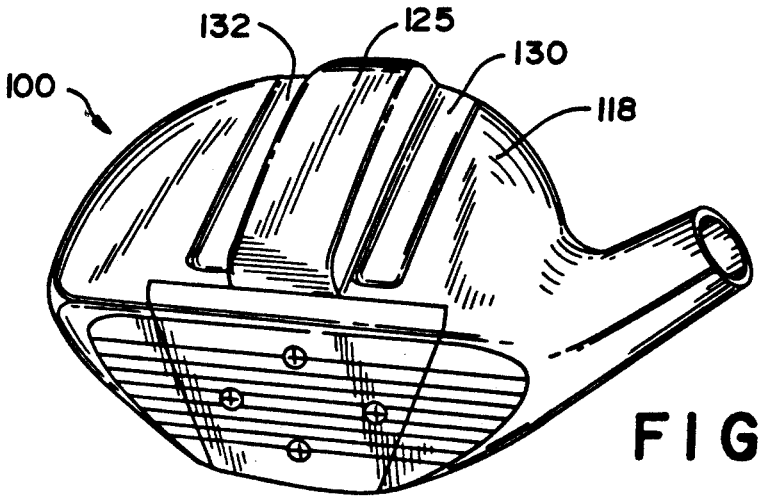
FIG. 5 is a front perspective view of the club head of FIG. 4.
Figure 6:
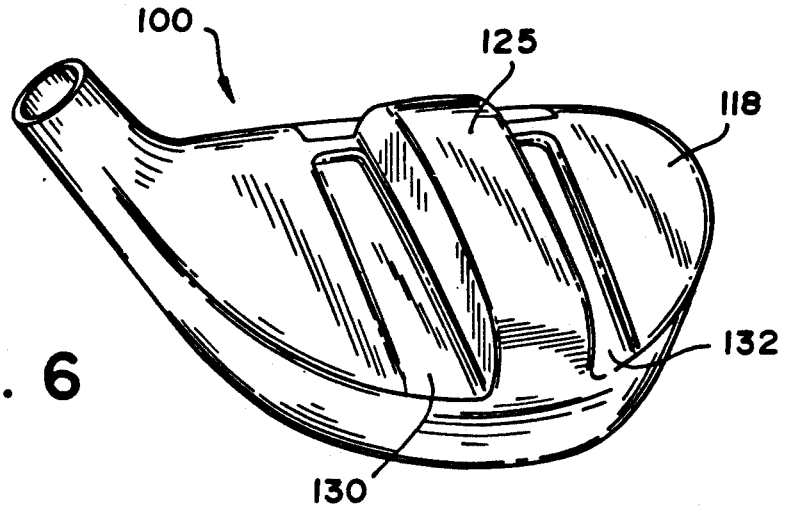
FIG. 6 is a rear perspective view of the club head of FIG. 4.

FIGS. 4, 5 and 6 show a second embodiment of a wood type golf club head 100 of the present invention, including an air foil member 125 in the top surface of the club head and further including a pair of channels 130 and 132 longitudinally positioned and cut into the top surface 118 along the longitudinal edge of the air foil member 125. This arrangement further redirects the air flow across the top surface 118 of the club head 100 and causes the air to flow past and downward from the rear surface to effectively reduce drag and increase club head speed.

FIGS. and 8 show still another embodiment of a golf club head 200 of the present invention, having an aerodynamic air foil 225 and a pair of channels 230 and 232 formed in the top surface 218 on either side of the air foil 225. The channels 230 and 232 flare outwardly toward the heel 214 and toe 216 directions of the club head, respectively. This arrangement provides still another air flow pattern which reduces club head drag and increases club head speed.

Figure 9:
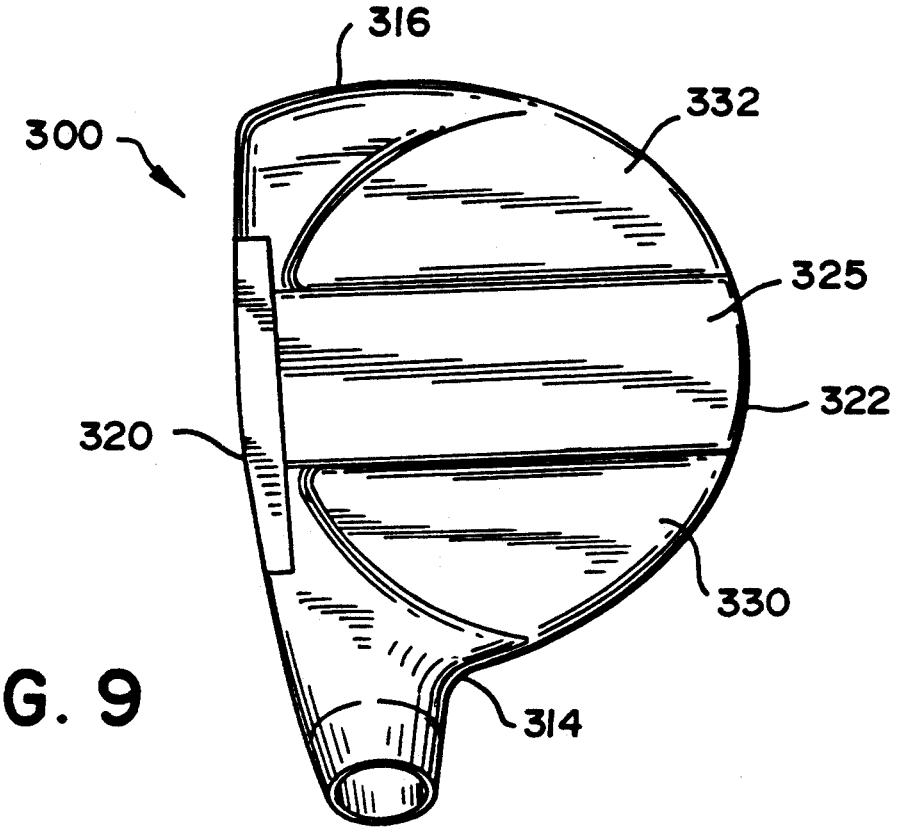
FIG. 9 is a top plan view of a fourth embodiment of the present invention.
Figure 10:
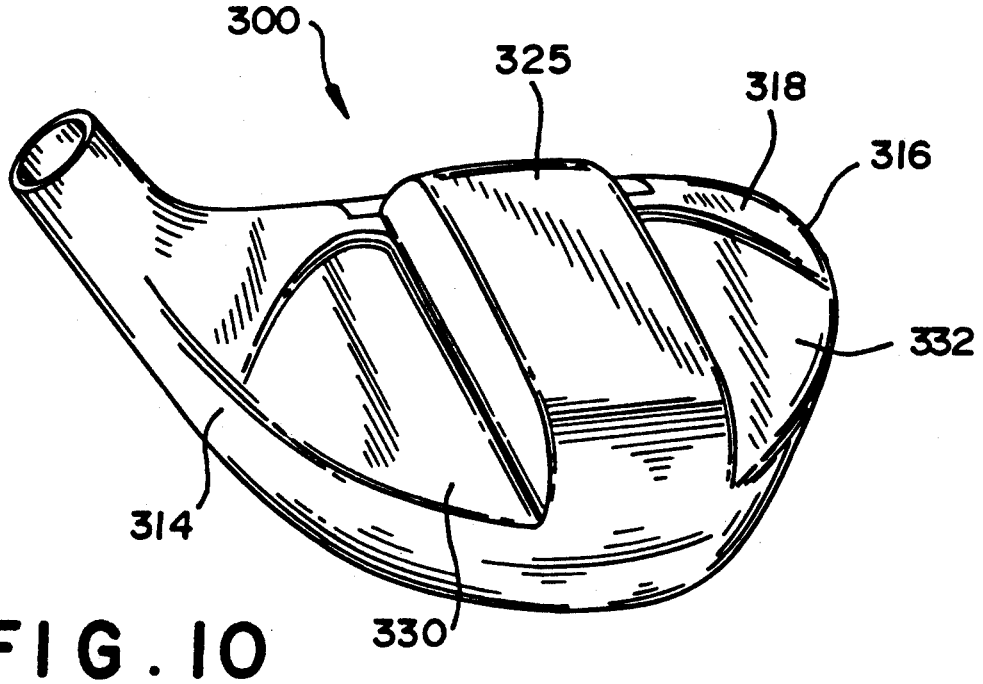
FIG. 10 is a rear perspective view of the club head of FIG. 9.

FIGS. 9 and 10 show still another embodiment of a golf club head 300 of the present invention, including an air foil member 325 and a pair of wide channels 330 and 332 on either side of the air foil member 325 formed in the top surface 318 of the club head 300. In this embodiment, the channels 330 and 332 extend to the peripheral edges of the club head 300 adjacent the toe 316 and heel 314, respectively, approximately midway between the ball striking face 320 and rear surface 322 of the club head. Here again, an additional desirable integrating air flow pattern is create which reduces drag and increases club head speed.

FIGS. 11 and 12 show a fifth embodiment of the golf club head 400 of the present invention, including an air foil member 425 located on the top surface 418 of the club head 400. In this embodiment, the air foil includes a downward slope 430 and a ramp 432 at the rear of the club head.

FIGS. 13 and 14 show a sixth embodiment of a golf club head 500 of the present invention, including an air foil member 525 formed on the top surface 518 of the club head 500. In this embodiment, the air foil extends only partway between the front and rear of the club head, and includes an upward sloping surface 530.

FIGS. 15 and 16 show a seventh embodiment of a golf club head 600 having an air foil 625 which is trapezoidal in shape located on the top surface 618 of the club head 600. In this embodiment, the sides 630 of the air foil 625 flare outwardly toward the rear of the club head.

FIGS. 17 and 18 show an eighth embodiment of a golf club head 700 of the present invention, including an air foil 725, the rear portion 730 of which flares outwardly.

FIGS. 19 and 20 show a ninth embodiment of a golf club head 800 having an air foil 825 with sloping shaped surfaces and being generally triangular in section. The air foil 825 begins at the rear surface 830 and extends only partway across the top surface 818 of the club head 800.

FIGS. 21 and 22 show a tenth embodiment of a golf club head 900 of the present invention, including an air foil 925 having upwardly sloping-shaped surfaces but which further include depressed air channels 930 adjacent the sides 932 of the air foil 925.

FIGS. 23 and 24 show an eleventh embodiment of a golf club head 1000 of the present invention, including a pair of air foil members 1025 having triangularly shaped sloped sides 1032, located rearwardly on the top surface 1018 of the club head.

FIGS. 25 and 26 show a twelfth embodiment of a golf club head 1100 of the present invention, including a pair of ramp-shaped air foil members 1125 located rearwardly on the top surface 1118 of the club head 1100.

FIGS. 27 and 28 show a thirteenth embodiment of a golf club head 1200 of the present invention, including a pair of rectangular-shaped air foil members 1225 located between the club face 1220 and the rear surface 1222 on the top surface 1218 of the club head.

Figure 29:
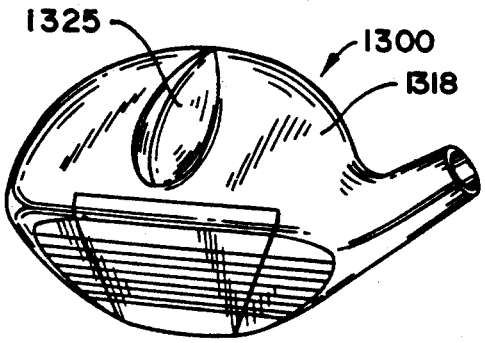
FIG. 29 is a front perspective view of a fourteenth embodiment of the present invention.
Figure 30:
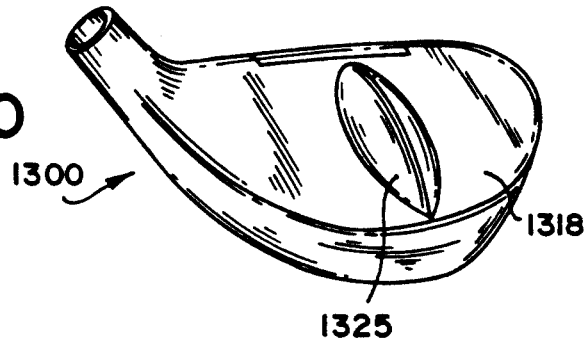
FIG. 30 is a rear perspective view of the club head of FIG. 29.

FIGS. 29 and 30 show a fourteenth embodiment of a golf club head 1300 of the present invention, including a single teardrop-shaped air foil 1325 located on the top surface 1318 of the club head 1300.

Figure 31:
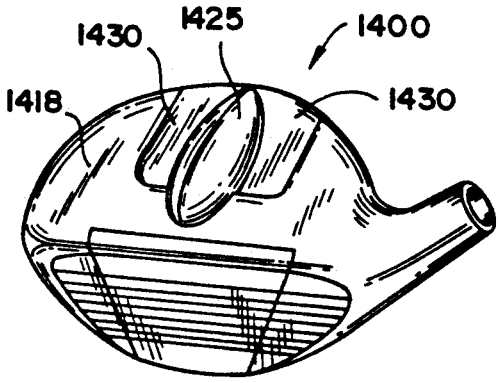
FIG. 31 is a front perspective view of a fifteenth embodiment of the present invention.
Figure 32:
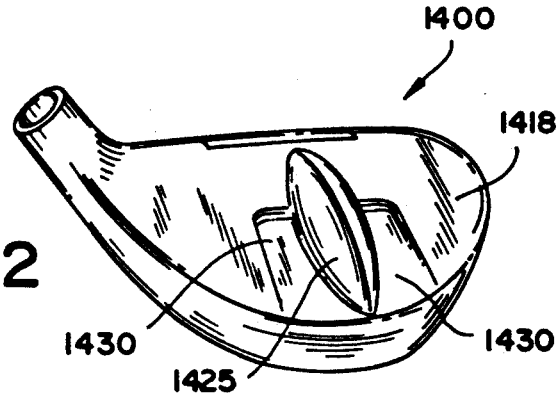
FIG. 32 is a rear perspective view of the club head of FIG. 31.

FIGS. 31 and 32 show a fifteenth embodiment of a golf club head 1400 of the present invention, including a tear-shaped air foil member 1425 centrally located on the top surface 1418 of the club head 1400. Depressed air channels 1430 are located adjacent to the longitudinal edges of the air foil 1425.

Figure 33:
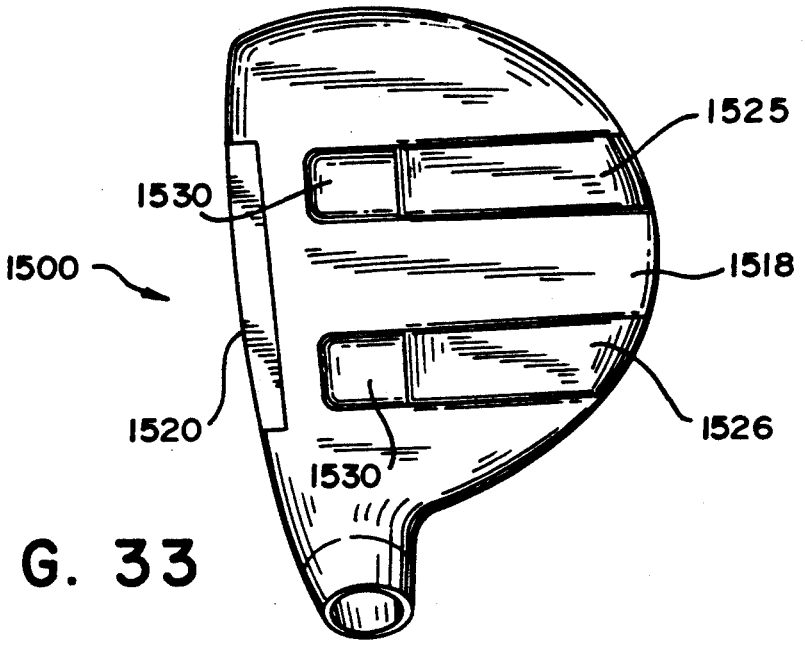
FIG. 33 is a top plan view of a sixteenth embodiment of the present invention.
Figure 34:
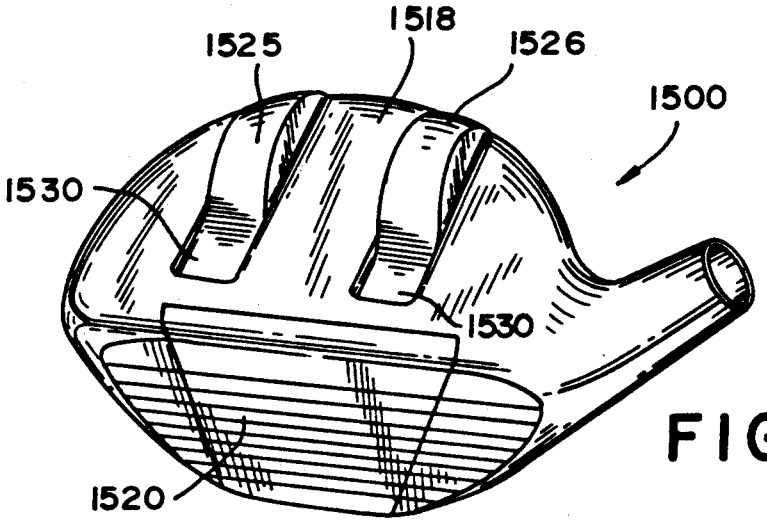
FIG. 34 is a front perspective view of the club head of FIG. 33.
Figure 35:
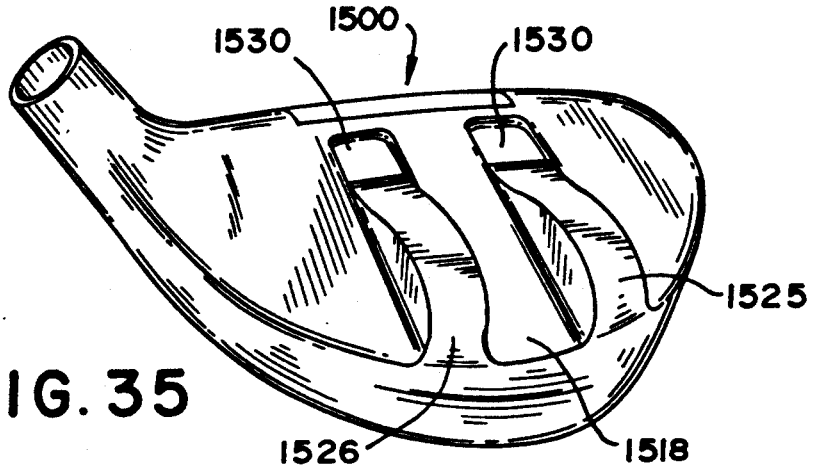
FIG. 35 is a rear perspective view of the club head of FIG. 33.

FIGS. 33, 34 and 35 show a sixteenth embodiment of a golf club head 1500 of the present invention, including a pair of air foil members 1525 and 1526 located on the top surface 1518 of the club head 1500. Each air foil member is parabolic in shape and includes an air recess 1530 located immediately in front of the air foil member and between each air foil member and the ball striking face 1520. The combination of the recesses and the air foil members creates an aerodynamic flow which reduces drag and increases club head speed as the club head is swung.

It will be appreciated that other embodiments of the club head may be provided in keeping within the spirit and scope of the present invention, as defined in the following claims.

I claim:

1. A wood type golf club head having a heel, a toe, a top surface, a bottom, a ball striking face and a rear surface, the improvement comprising:

means for reducing the aerodynamic drag on the club head and providing increased club head speed for a given force when swinging the club;

said means including at least one elongated, rectangularly shaped member having a height of at least ¼ inch extending above the top surface and a width of at least ½ inch in the heel to toe direction, said member having a leading edge extending upwardly adjacent to and slightly behind said ball striking face and a trailing edge terminating adjacent said rear surface, said member including a planar upper surface and sides extending between said planar upper surface and said top surface of said golf club head, said sides defining the height of the member; and, said member forming an air foil for creating air flow turbulence as the golf club is swung.

2. The wood type golf club head of claim 1, further including a pair of longitudinal air channels positioned adjacent said shaped member and extending between said ball striking face and said rear surface, said channels in combination with said shaped member further increasing the aerodynamic effects on the air flow when said golf club head is swung.

3. The wood type golf club head of claim 2 wherein said channels are slots having edges parallel to the sides of said shaped member.

4. The wood type golf club head of claim 2 wherein the channels include edges which flare outwardly between said ball striking face and said rear surface.

5. The wood type golf club head of claim 4 wherein said edges of said channels extend to the peripheral edges of the club head adjacent the toe and heel of the club head approximately midway between the ball striking face and the rear surface.

6. The wood type golf club head of claim 1 wherein said shaped member includes a downward slope approximately midway along the longitudinal axis of the shaped member, and an upward ramp located adjacent a rear section of the shaped member at the rear surface of the club head.

7. The golf club head claim 1 wherein said shaped member extends partway between the ball striking face and a rear surface of the club head, and includes a ramp having an upward-sloping surface sloped in the direction toward the rear surface of the club head.

8. The golf club head of claim 1 wherein said shaped member is trapezoidal in shape, having sides which flare outwardly toward the rear surface of the club head.

9. The golf club head of claim 1 wherein said shaped member includes a forward section with parallel sides and a rearward section having sides which flare outwardly toward the rear surface.

* * * * *